United States Patent [19]

Beard

[11] 4,436,229

[45] Mar. 13, 1984

[54] HIGH FLOW TILT VALVE WITH ACCELERATING CAM EQUIPPED MOVEABLE CUP

[76] Inventor: Walter C. Beard, South Street, Middlebury, Conn. 06762

[21] Appl. No.: 432,298

[22] Filed: Oct. 1, 1982

Related U.S. Application Data

[63] Continuation-in-part of Ser. No. 405.696, Aug. 5, 1982, abandoned.

[51] Int. Cl.[3] ..... B65D 83/14

[52] U.S. Cl. ..... 222/402.22; 222/402.21

[58] Field of Search ..... 222/83.5, 88, 153, 402.1, 222/402.21, 402.22, 518

[56] References Cited

U.S. PATENT DOCUMENTS

| | | | |
|---|---|---|---|
| 2,487,434 | 11/1949 | Geiss et al. | 222/394 |
| 2,660,132 | 11/1953 | Pyenson . | |
| 2,667,991 | 2/1954 | Boyer . | |
| 2,709,111 | 5/1955 | Green . | |
| 2,729,368 | 1/1956 | Lapin et al. . | |
| 2,731,298 | 1/1956 | Green . | |
| 2,739,841 | 3/1956 | Soffer . | |
| 2,953,284 | 9/1960 | Prussin et al. . | |
| 3,060,965 | 10/1962 | Taggart . | |
| 3,096,003 | 7/1963 | Nesin | 222/518 X |
| 3,216,463 | 11/1965 | Kibbel, Jr. et al. . | |
| 3,255,936 | 6/1966 | Healy et al. . | |
| 3,348,743 | 10/1967 | Green | 222/402.24 |
| 3,506,241 | 4/1970 | Ewald | 222/402.21 X |
| 3,547,405 | 12/1970 | Ewald . | |
| 3,581,941 | 6/1971 | Bruce et al. . | |
| 3,635,379 | 1/1972 | Angele . | |
| 3,735,955 | 5/1973 | Kerr et al. | 222/402.21 X |
| 3,830,760 | 8/1974 | Bengtson . | |
| 4,171,757 | 10/1979 | Diamond . | |

OTHER PUBLICATIONS

Three pages, Unnumbered and Undated from a Catalogue Issued by Clayton Corp., 4205 Forrest Park Blvd., St. Louis, MO 63108.

Reprint of Article by Walter C. Beard from Aerosol Age Apr., May 1966 Entitled "Aerosol Valves Up-to--Date".

Reprint of Article by Walter C. Beard from Aerosol Age Entitled "The Beard Universal Seal-Tip Valve" Apr. 1972.

*Primary Examiner*—Joseph J. Rolla
*Assistant Examiner*—Thomas C. Fitzgerald
*Attorney, Agent, or Firm*—Hill, Van Santen, Steadman & Simpson

[57] ABSTRACT

A tilting nozzle valve assembly incorporating a nozzle actuated moveable cup member. The valve assembly has a high flow capability for passing highly viscous fluids therethrough. The moveable cup member provides a positive valve sealing action between itself and a gasket in the valve assembly. The moveable cup member features a camming member which provides both an accelerated valve opening action responsive to nozzle tilting and also a maximizable opening between the moveable cup member and the gasket.

21 Claims, 12 Drawing Figures

HIGH FLOW TILT VALVE WITH ACCELERATING CAM EQUIPPED MOVEABLE CUP

RELATED APPLICATION

This application is a continuation-in-part of my earlier filed U.S. patent application Ser. No. 405,696 filed Aug. 5, 1982, the entire disclosure and contents of which is incorporated herewith by reference.

BACKGROUND OF THE INVENTION

1. Field of the Invention

This invention lies in the field of tiltable valves for pressurized containers, especially valves adapted to dispense viscous fluids, and also to improved moveable cup members for such valves.

2. Description of the Prior Art

In the art of aerosol valves, it has heretofore been appreciated that tiltable valve assemblies can employ among their components a moveable cup member (see, for example, Ewald U.S. Pat. No. 3,547,405). Characteristically, in such prior art aerosol valve assemblies, such a moveable cup member has served as a means for introducing turbulent type flow into the fluid stream being dispensed which is desirable in order to produce a homogenous aerosol comprised of material being dispensed in admixture with the pressurizing propellant in a vapor phase.

When, however, it is desired to dispense a highly viscous fluid, a completely different type of fluid flow through such a valve structure during dispensing is desired and is even necessary for operability reasons. For a viscous liquid, fluid flow through such a valve structure should be laminar in type and not turbulent.

In turbulent flow, it is typical in the art to utilize small clearance passages particularly in the region of the moveable cup member which then feeds into a relatively larger passageway out of which the aerosol is finally vented. When a tiltable valve structure containing such small passageways in the region of the moveable cup is used for an attempt to dispense a viscous fluids, it is discovered that severe problems exist owing to the difficulty of passing a viscous liquid through such narrow passageways. As a practical matter, it is found that narrow passageways in the region of the moveable cup member produce a generally inoperative valve structure for the dispensing of highly viscous fluids.

In order to provide a valve assembly for use with an aerosol type dispensing container from which a viscous liquid is to be dispensed, it is desirable, then, to have cross-sectionally very large and longitudinally very short passageways through which such a viscous liquid must pass to be dispensed.

The achievement of a tiltable valve assembly which employs a moveable cup member with extremely large passageways not only in the region of the moveable cup member, but also in the region of the valve aperture formable between the moveable cup member and a gasket, combined with the necessity to have a positive valve sealing action when the valve structure is in a closed configuration, represents a problem in the prior art which so far as is now known has not been previously solved.

BRIEF SUMMARY OF THE INVENTION

This invention is directed to a new and improved tiltable valve assembly adapted for the dispensing of highly viscous fluids from pressurized containers wherein a maximizable valve aperture is provided during a valve opening operation. Such valve assembly can be manufactured in an assembled configuration, subsequently stored, and then assembled as a unit onto a desired pressurizable container without further valve assembly modification.

The present invention is also directed to a tiltable valve assembly incorporating a moveable cup member which has a high flow capability for highly viscous fluids therethrough and which has a positive sealing action between the moveable cup member and a gasket means in the valve assembly when the valve assembly is in a closed configuration. This moveable cup member is characterized by the new and improved feature that it includes a camming member which permits the development of a maximum sized aperture between the moveable cup member and such gasket means through the tilting of an elongated tubular nozzle means whose interior end portion engages such camming member.

The present invention is further directed to an improved dispensing device for dispensing highly viscous fluids which utilizes in combination a pressurizable container and a tiltable valve assembly of the type here provided.

More specifically, the present invention concerns an improved tiltable valve assembly. Such an assembly includes a mounting cup member sealingly securable to a pressurized container and having communication with the pressurized contents of said container. Carried within said mounting cup member, is a resilient seal member. An elongated tubular nozzle means is provided having a dispensing orifice in one end thereof and having a second end generally opposite to said one end extending through said mounting cup member, such tubular nozzle means is supported in said mounting cup member by such resilient seal member in a normally generally straight upright extended position.

A moveable valve cup member is reciprocally slidably carried within said mounting cup member and is normally biased against said resilient seal member to form a seal means for normally sealing the contents of an associated container. Such moveable valve cup member is engageable with such second end of such tubular nozzle means and the contents of such pressurized container are dispensable when the one end of such tubular nozzle means is tiltably displaced relative to its generally straight upright extended position by an external deflecting operating force applied thereagainst, thereby opening such seal means. The moveable valve cup member includes a base portion extending across said second end of said tubular nozzle means, rib means upstanding from said base portion for engaging said resilient seal member peripherally of said tubular nozzle means, guidance means for orienting said moveable valve cup member relative to said mounting cup member for stable reciprocal sliding movements longitudinally relative to said mounting cup member, and a camming member for engaging a bottom edge of such tubular nozzle means to enhance the aperture achievable between said rib means and said resilient seal member. Channel means are also defined in said moveable valve cup member longitudinally extending therethrough for the laminar flow of a viscous fluid therethrough.

The interrelationship between said cam equipped moveable valve cup member, said tubular nozzle means, said resilient seal member, and said mounting cup member is such that a substantially unobstructed flow of said contents through said valve structure can occur when said one end is so tiltably displaced.

Various other advantages, features, objects, aims, purposes, and the like will be apparent to those skilled in the art from the accompanying specification and drawings.

DETAILED DESCRIPTION

Figure 1:
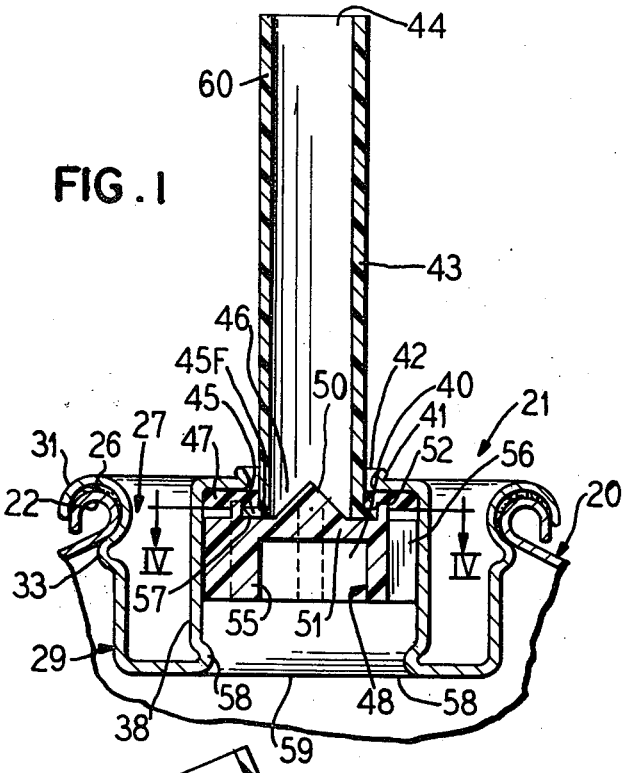
FIG. 1 is a vertical sectional view along the axis of one embodiment of a container fitted with one embodiment of a valve structure of the present invention, some parts thereof being shown in elevation and some parts thereof being broken away.

Referring to FIGS. 1–5, a dispensing container or can 20 is fitted on its top end with a tilt valve structure 21 of the present invention. Container 20 is provided with an axially located aperture 27 having a rolled perimenter 22, container 20 being formed in this instance of sheet metal.

Container 20 may be structured as described for container 20 in my above cited U.S. patent application Ser. No. 405,696.

The tilt valve structure 21 includes a metallic mounting cup 29 which terminates in a rolled perimeter 31 that is adapted to make nesting engagement with the rolled perimenter 22. Interior surfaces of the roll 31 are provided with a coating 26 formed of a sealing material of resilient, elastomeric plastic composition, such a chloroprene rubber composition, or the like, so that when the mounting cup 29 is fitted over the roll 22 and formed by collet fingers, there is produced a retaining crimp 33 in cup 29, and the preformed valve structure 21 is thus sealingly associated with the container 20.

While the valve structure 21 is particularly well suited for the dispensing of a viscous fluid from a chamber 34, as described, the valve structure 21, as those skilled in the art will readily appreciate, is also suitable for the dispensing of a viscous fluid which has admixed therewith a gaseous propellant in an appropriate pressurized chamber or container where the propellant can be, for example, a member of the well-known low molecular weight fluorocarbon family. Valve structure 21 can thus be used, if desired, for dispensing aerosols and gaseous fills generally.

Examples of viscous liquid or semisolid fills which one can dispense from a container with valve assembly as shown in FIG. 1 include, for example, sealants, grease, cheeses, food toppings, syrups, toothpaste, whipped creams, including shaving creams, dermal (e.g., hand or face) creams, and the like.

As those skilled in the art will appreciate, the internal diameter of the aperture 27 defined by the rolled perimeter 22 is typically standardized in the valve trade while the conventional mounting cup 29 is so formed as to have an inner wall member 38 defined therein which can have a diameter and an axial length as particularly chosen for an individual type of valve structure desired.

Through the center portion and along the axis 40 of the mounting cup 29 is an aperture 42 which can be optionally provided, as in assembly 21, with an upstanding lip 41 which serves as a stiffening or reinforcing means about the aperture 42. Through the aperture 42 is extended a nozzle stem member 43 which, at its upper end portion, is provided with a dispensing orifice 44, and which, at its opposite end portion, is provided with a radially outwardly extending flange 45 that is here integrally formed with the nozzle stem member 43. The nozzle stem member 43 extends also through a central aperture 46 of a resilient elastomeric gasket 47 which gasket 47 also makes abutting contact with both adjacent outer wall portions of the nozzle stem member 43 and the flange 45. The outer perimeter of gasket 47 is seated in the center portion of the mounting cup 29. The nozzle stem 43 is in a normally upright configuration as illustrated in FIG. 1.

A moveable cup member 48 is disposed for axial sliding movements in the region of the central portion of mounting cup 29. The moveable cup member 48 includes a valve plate 51 which transversely (relative to nozzle stem member 43) extends across flange 45 and further includes adjacent the outer periphery of valve plate 51 an integrally formed associated upstanding rib portion 52 when the valve structure 21 is in its closed configuration as shown in FIG. 1 makes a seating engagement with adjacent portions of the gasket 47.

Also, integrally associated with the valve plate 51 are a plurality of radially (relative to plate 51) outwardly extending guide ribs 53 which are configured so as to be equally sized and in a spaced, adjacent, or even optionally contacting, slidable relationship with respect to adjacent wall portions of wall 38. The individual guide ribs 53 are in circumferentially preferably equally spaced relationship to one another. In the embodiment shown, the guide ribs 53 extend axially downwardly away from the valve plate 51 relative to wall 38 to an extent sufficient to stabilize slidable movements of the moveable cup member 48 relative to the mounting cup 29 and prevent cocking of valve plate 51.

A rearwardly (relative to gasket 47 and nozzle stem member 43) or downwardly axially extending apron 55 integrally extends from valve plate 51 in radially spaced relationship to the ribs 53. The principal purpose of this apron 53 is to provide a point of attachment for the adjacent portions of individual ribs 53 thereby to provide a reinforcing means for supporting the ribs 53 in the moveable cup member 48.

Between circumferentially adjacent pairs of guide ribs 53 substantial clearance passages 56 are provided which extend radially between the adjacent sidewall portions of the walls 38 and adjacent portions of apron 55 and the valve plate 41. The relatively large openings or passageways 56 permit the passage through the valve assembly 21 of large volumes of material to be dispensed therethrough which is particularly desirable for the dispensing of highly viscous fluid material.

The moveable cup member 48 is further provided with a pocket 57 across the upper face of valve plate 51 between the rib portion 52. In this pocket, the inner end portion in the region of flange 45 of nozzle stem member 43 is receivable so that such is in an adjacent but preferably noncontacting relationship with respect to the valve plate 51 when the valve structure 21 is in its closed configuration as shown in FIG. 1. In this way, the rib portion 52 can be allowed to be received into a sealing engagement with contacting adjacent portions of the gasket 47 without interference from stem member 43.

The moveable cup member 48 is further provided with a centrally located camming member 50 positioned on valve plate 51 and preferably (and as shown) being integrally formed therewith. Valve plate 51 has a flat annular face 51F positioned peripherally about camming member 50, the face 51F being adapted to mate generally with the face 45 F of flange 45 F nozzle stem member 43. The face 50 F of camming member 50 is inclined relative face 51 F, the angle of inclination relative to face 51 F being generally greater than 0° and smaller than about 70° with a presently preferred such angle following in the range from about 30° to 60°. This camming angle of inclination is generally one which will permit the transverse tilting motion of the nozzle stem member 43 (which motion occurs during opening and closing of the valve 21) to be converted into vertical movement of moveable cup member 48 with the position of the cup member 48 being predictably determined by the position of stem member 43 at any given time.

The face 50 F is generally radially symmetrical about the axis 50 of valve assembly 21. The surface configuration of face 50 F can be, for examples, conical, spherical, eggshaped, or the like. The effect of camming member 50 is to magnify the extent of downward travel of moveable cup member 48 to an unexpected and surprising extent during valve opening, thereby to increase in a highly desirable manner the opening 61 forward between rib portions 52 and gasket 47 when valve 21 is in an open configuration. The surface configuration of face 50 F in any given embodiment can be chosen so as to achieve a particular effect, such as making the opening 61 at some given angle of tilt of nozzle stem member 43 have a size considered to match the size of the passageways 56 in the vicinity of opening 61 or the like.

A crimped portion 58 is formed about the mouth 59 of wall 38, by collet fingers or the like in the valve assembly, so as to provide a stop means limiting extent of axial slidable movements of the moveable cup member 48 relative to wall 38. Thus, the assembly of the valve structure 21 can remain integral during storage and after assembly onto a container 20, or the like.

Figure 2:
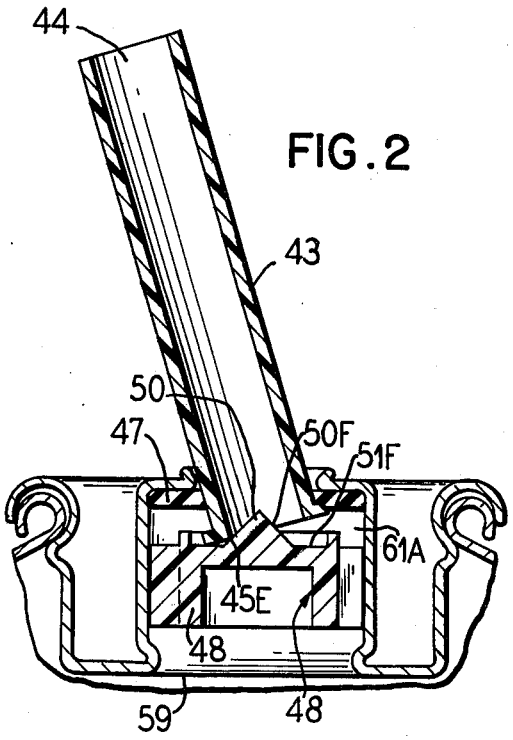
FIG. 2 is a view similar to FIG. 1, but illustrating such valve structure in a partially open (stem tilted) configuration at the end of a first stage of valve operation.

When an external operating deflecting force is applied against the outer or tip end 60 of the nozzle stem member 43, the flange 45 is, in a first phase of valve operation, moved against the valve plate 51, thereby causing the moveable cup member 48 to slidably move towards crimped portion 58 resulting in the unseating and separating of the rib portions 52 relative to the gasket 47, on forming a first phase opening 61 A therebetween, as shown in FIG. 2.

Figure 3:
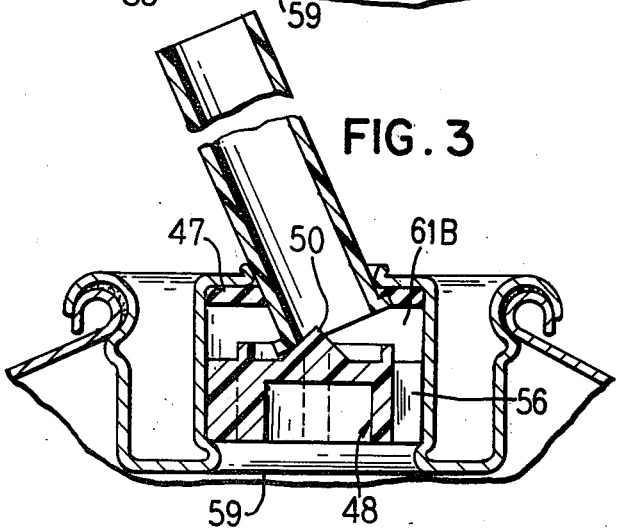
FIG. 3 is a view similar to FIG. 1, but illustrating such valve structure in a fully open (stem tilted) configuration at the end of a second stage of valve operation.
Figure 4:
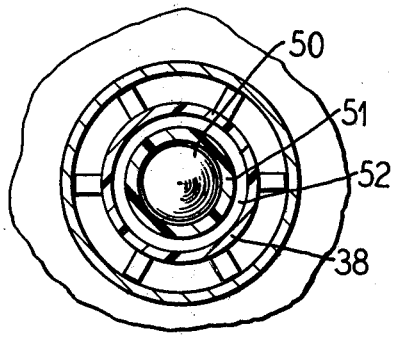
FIG. 4 is a transverse sectional view taken along the line III–IV of FIG. 1.
Figure 5:
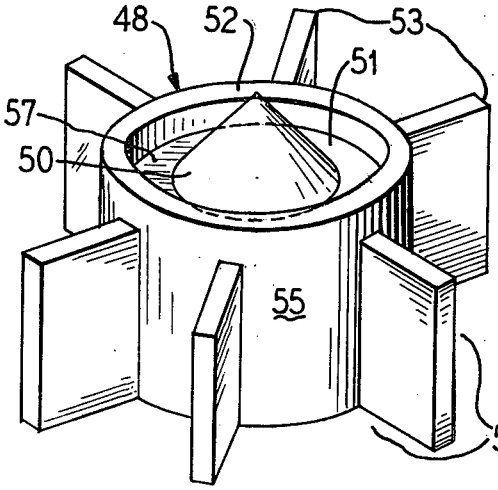
FIG. 5 is an isometric view of the moveable valve cup member employed in the embodiment shown in FIGS. 1–4.

With a further inclination or tilting of nozzle stem member 43 beyond the configuration shown in FIG. 2, where the flange 45 remains in contact with valve plate 51, the edge 45 E of flange 45 slidably moves along the face 50 F of camming member 50 away from face 51 F of valve plate 51. As such sliding movement occurs, moveable cup member 48 is caused to move further away from gasket 47 from its position shown in FIG. 2 to its position shown in FIG. 3. Thus, the size of the opening 61 A is increased very substantially to form the opening 61 B shown in FIG. 3, thereby permitting pressurized contents in the container 20 to flow upwardly and outwardly through the nozzle stem member 43 via the dispensing orifice 44 as shown in FIG. 3. In normal operating configuration, after such an opening of the valve structure 21, there results a flow of the pressurized contents from within the container 20 in a laminar manner through the clearance passageways 56, past the open area 61 B between the rib portions 52 and the gasket 47, and into and through the nozzle stem member 43, as shown in FIG. 3. Opening 61 B is regardable as being generated in a second phase of a valve opening operation.

As can be seen from FIGS. 1, 2, and 3, one effect of camming member 50 is to accelerate the opening rate or rate at which moveable cup member 48 is separated from gasket 47 during a tilting of nozzle stem member 43 compared to the corresponding opening rate achievable with no camming member 50 and with a flat face across valve plate 51. Another effect of camming member 50 is to increase substantially the size of the opening formed between moveable cup member 48 (specifically, rib portion 52) and gasket 47 compared to the corresponding opening achievable with no camming member 50 and a flat face across valve plate 51. The quantitative comparative difference in opening size is set by the distance which flange 45 is elevated from valve plate 51 by the configuration by a given camming member 50. A further effect of camming member 50 is to increase the potential flow rate of material to be discharged from container 20 through valve 21 since for a given value 21 configuration (including passageways 56), the larger the opening 61 B, the greater is the flow rate and volume through valve 21 up to some maximum valve. A still further effect of camming member 50 is to enable one to regulate the size of opening 61 B relative to the size and configuration of passageways 56 so as to provide, for example, a particular optimized interrelationship therebetween, such as may be desirable for dispensing a particular type of material. Yet a further effect of camming member 50 is to permit a maximization of movement of moveable cup member 48 along axis 40 relative to a given amount of tilt movement of nozzle stem member 43 which can be important for a given valve configuration of the moveable cup type where inherent limits of design can sometimes be a consideration, such as the extent to which, for example, a given nozzle stem member 43 can be inclined in a valve 21 relative to lip 41.

When valve closure is desired, the tip end 60 is allowed to return to its normally upright configuration which effects a reversal of the operations described above and which thus effectuates a resealing between the rib portions 52 and the gasket 47. The resealing is effectuated in the embodiment of container 20 and valve structure 21 shown by the interior pressure exerted upon the underside of the moveable cup member 48 from the pressurized fill contents in container 20.

Figure 6:
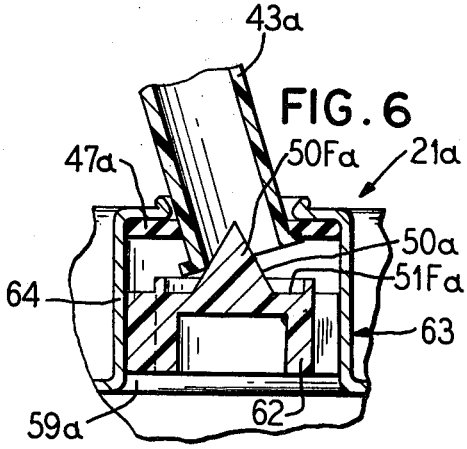
FIG. 6 is a view similar to FIG. 3, but illustrating a further embodiment of a valve structure of the present invention.

Referring to FIG. 6, there is seen an alternative embodiment of the valve structure 21, the alternative valve structure embodiment in FIG. 6 being designated in its entirety by the designation 21*a*. Components of the valve structure 21*a* which are similar in configuration and function to corresponding components in valve structure 21 are similarly numbered but with the addition of the letter "a" thereto for convenience. In valve structure 21*a*, the moveable cup member 62 is here formed with an integral conically configured camming member 50*a* which has steeper angle of inclination (relative to face 51 F) for its face 50 Fa than does face 50 F of camming member 50 of moveable cup member 48. Also, the mounting cup 63, though otherwise similar to mounting cup 29, is here provided with no crimped portion about the mouth 59*a* of wall 64. Internal pressure exerted on the underside of moveable cup member 62 in an aerosol-type container, or the like, with which the valve structure 21*a* is to be associated in use, is employed to retain the components of valve structure 21*a* in an assembled and operative configuration, as those skilled in the art will appreciate.

In each of these valve structures, the internal pressure within an associated pressurized dispensing container 20 serves to maintain a yielding bias upon the moveable cup member tending to maintain these respective valve structures in a normally closed configuration.

In all of these valve structure, the moveable cup member is configured so as to provide a maximum cross-sectional area which is done for purposes of permitting the passage therethrough of viscous material being dispensed. In addition, the axial distance (along the valve axis) of such passageways through each moveable cup member are configured so as to be as short as possible consistent with the requirements of stable, reliable valve operation. The type of flow characteristic achieved through the moveable cup member in valve structures of this invention is such as to promote laminar flow as opposed to turbulent flow, the latter flow type being characteristic of the flow achieved with prior art valve structures, particularly the prior art valve structures wherein gases are being dispensed and wherein turbulent flow aids in the dispensing of a homogenous, uniform aerosol spray. The valve structures of the present invention are thus particularly well suited for the dispensing of highly viscous liquids or fluids.

Figure 7:
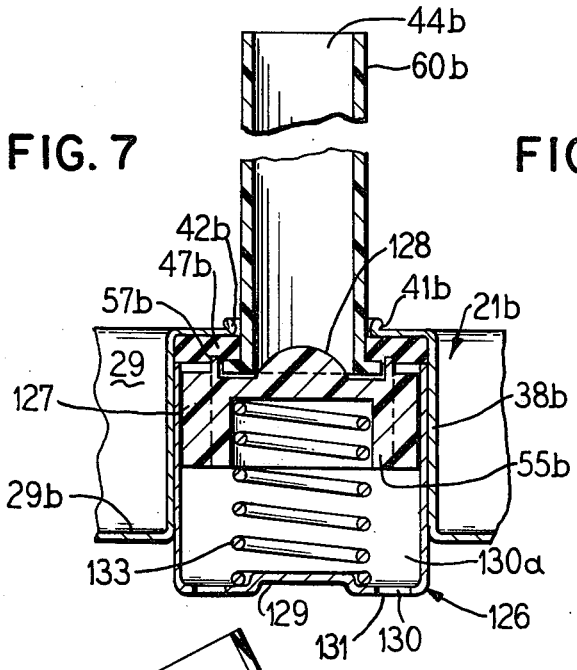
FIG. 7 is a view similar to FIG. 1, but illustrating a further alternative embodiment of a valve structure of the present invention.
Figure 8:
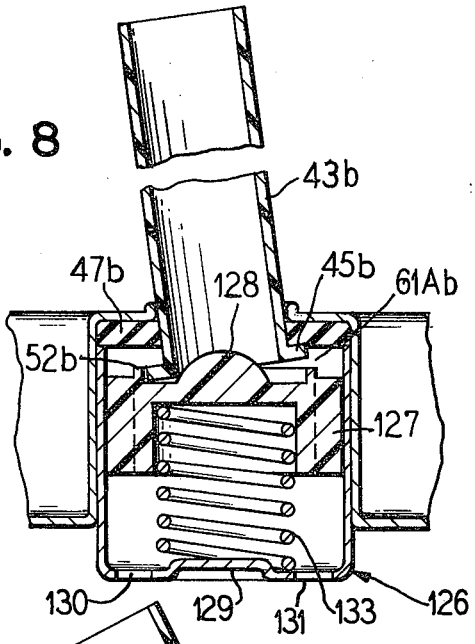
FIG. 8 is a view similar to FIG. 7, but illustrating such valve structure in a partially open (stem tilted) configuration at the end of a first stage of valve operation.
Figure 9:
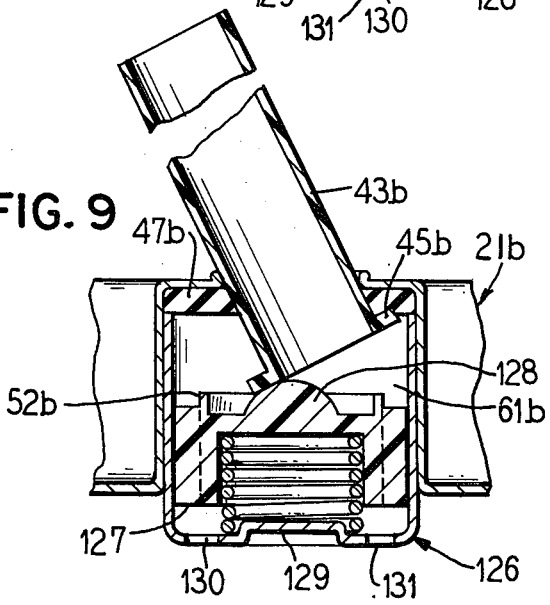
FIG. 9 is a view similar to FIG. 7, but illustrating such valve structure in a fully open (stem tilted) configuration at the end of a second stage of valve operation.

Referring to FIGS. 7, 8, and 9, there is seen another embodiment of a tilt valve structure of the present invention which is herein designated in its entirety by the numeral 21*b*; components of valve structure 21*f* which correspond to components of valve structure 21 are similarly identified but with the addition of the letter "b" thereto in each instance.

In place of the crimped portion 58 of mounting cup 29 in valve structure 21, there is here employed a bridge support means 126 which is here represented by a cup shaped embodiment that is preferably formed of sheet metal. Sidewall portions 127 of the bridge support 126 are frictionally engaged with adjacent sidewall portions of walls 38*b* of mounting cup 29*b*, thereby fixing the position of the bridge support 126 relative to the mounting cup 29*b*. Thus, the inner, cross-sectionally generally circular, wall surfaces of a central cavity 128 are identified and defined by the inner sidewalls 127. In place of a frictional engagement between the sidewalls 127 and wall member 38*b*, one can employ any convenient conventional securing means, including an adhesive, or the like, if desired.

The bottom or central portin 129 of the bridge support 126 is configured in the form of a spider wherein legs 130 join at their outer end portions with the sidewalls 127 and at their inner end portions with the central section 129 of the bridge support 126. The legs 130 are preferably circumferentially equally spaced from one another. The open areas 131 between circumferentially adjacent pairs of legs 130 provides apertures through which the fill contents being dispensed from a pressurized container associated with the valve structure 21*b* can pass when such valve structure is in an opened configuration. The structuring of the bridge support 126 is preferably such as to maximize the total cross-sectional area of the open areas or passageways 131 while leaving sufficient rigidity in the legs 130 to keep them spacially positioned as shown in FIGS. 7–9 during operation of such valve structure 21*b*. The central section 219 of bridge support 126 includes a boss which is adapted to receive thereover a coiled compression spring member 133 at one end thereof; the opposed end of spring 133 is received against the valve plate 51*b* in radially adjacent relationship to the apron 55*b*. The function of the spring 133 is to yieldingly maintain the valve structure 21*b* in a normally closed configuration wherein the nozzle stem member 43*b* is in the upright configuration depicted in FIG. 7; the spring 133 thus ensures an adequate seal between the rib portion 52*b*and the gasket 47*b*.

In valve structure 21*b*, the moveable cup 127 is structured similarly to moveable cup 48 except that here the integral camming member 128 is hemispherically configured. The first and the second phases of operation of valve structure 21*b* are shown, respectively, in FIGS. 18 and 19 which, as those skilled in the art will readily appreciate, correspond to FIGS. 2 and 3 of valve structure 21, respectively.

As can be seen by reference to FIG. 9, when the valve structure 21*b*is in an open configuration with the nozzle stem member 43*b* tilted, the spring 133 is compressed by the downward movement of the moveable cup 48*b*. The spring 133 thus introduces no impediment to the flow of viscous liquid or the like through the valve structure 21*b*.

Figure 10:
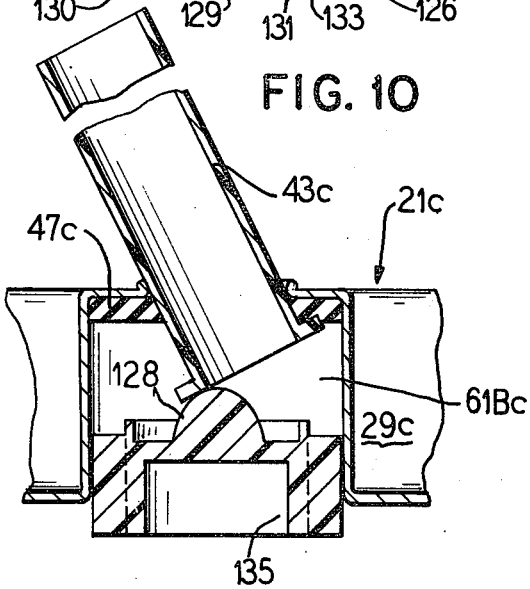
FIG. 10 is a view similar to FIG. 9, but illustrating a further alternative embodiment of a valve structure of the present invention.

Referring to FIG. 10 there is seen a further embodiment of a valve structure embodiment of the present invention which is herein designated in its entirety by the numeral 21*c*. Components of valve structure 21 corresponding to components in valve structure 21*c* are similarly numbered but with the addition of the letter "c" thereto for convenience. The valve structure 21*c* is comparable to the valve structure 21*b* except that here the moveable cup 127 of valve structure 21*b* is replaced by a moveable cup 135 wherein the integral camming member 128 is a cross-sectionally elliptically configured body. At the end of the second phase of valve operation, the camming member 128 is comparatively seen to produce a larger opening 61Bc than is obtained with the camming member 128 in valve structure **21*b* (see FIG. 9**).

This valve structure **21*c* employs an arrangement of components similar to those employed in valve structure 21*a*** and the operation is similar also.

Figure 11:
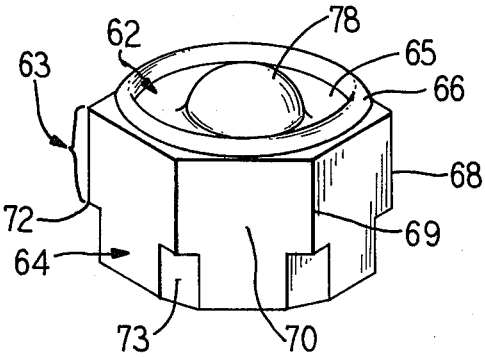
FIG. 11 is an isometric view of an alternative embodiment of a moveable valve cup member employable in the embodiment shown in FIGS. 7–10.
Figure 12:
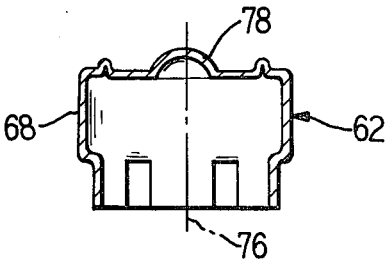
FIG. 12 is a vertical sectional view through the moveable valve cup member of FIG. 11.

Referring to FIGS. 11 and 12, there is seen an alternative embodiment of a moveable cup member 62 adapted to be employed in valve structure 21 in place of moveable cup member 48. The moveable cup member 62 is here formed of a conformable sheet material, such as sheet metal or the like. Alternatively, as those skilled in the art will appreciate, the moveable cup member 48 can be formed of molded plastic, molded metal, or the like, as desired. The moveable cup member 62 is characterized by having an upper portion 63 which is adjacent the valve stem member 43 and by having a rear portion 64 which is adjacent the interior of the vessel 20. The upper portion 63 includes a valve plate 65 which has a peripheral upstanding rib portion 66 that is adapted to make seating contact with gasket 47, a pocket is thus formed by the valve plate 65 with rib portions 66 for receipt of the base and flange 45 or the stem member 43. The cross-sectional configuration of the sidewalls 68 of the upper portion 63 are hexagonally configured, as shown, for example, in FIG. 11. In this hexagonal configuration, the peaks define rib portions 69 which are adapted to make sliding engagement with wall portions 38 for guidance of the moveable cup member 62. The flattened wall portions 70 between adjacent rib portions 69 define, in relation to the radially spaced wall portions 38, passageways (not shown) for the movement of fluid being dispensed through the valve member 21. Thus, the passageways are comparable to the passageways 56 in the moveable cup member 48.

The lower sidewall portion 73 of the rear portion 64 are set back by a step portion 72 so as to provide a clearance passageway (not shown) between the lower sidewall portions 73 and the crimped portion 58. To achieve such setback and production of clearance passageway, the lower sidewall portions 73 are setback towards the axis 76 of moveable cup member 62 in longitudinally adjacent relationship to each rib portion 69. The step portion 72 limits travel of moveable cup member 62 relative to crimped portion 58.

The moveable cup member 62 is provided with an integral dome-configured camming member 76 centrally formed in valve plate 65 which functions similarly to camming member 50 in moveable cup member 48.

Although the teachings of my invention have herein been discussed with reference to specific embodiments, it is to be understood that these are by way of illustration only and that others may wish to utilize my invention in different designs or applications. Utilization of the camming means provided by this invention in combination with the various moveable cup members shown and described in the above referenced parent U.S. patent application will be apparent to those skilled in the art and is generally contemplated by the present teachings.

I claim:

1. A fluid dispensing valve structure for dispensing the viscous contents of a pressurized container comprising:

a mounting cup member sealingly securable to said pressurized container and having communications with the pressurized contents of said container, a resilient seal member carried within said mounting cup member, an elongated tubular nozzle means having a dispensing orifice in one end thereof and having a second opposed and outwardly flanged end extending through said mounting cup member and supported in said mounting cup member by said resilient seal member in a normally generally straight upright extended position, a moveable valve cup member reciprocally slidably carried within said mounting cup member and normally biasable against said resilient seal member to form a seal means for normally sealing the contents of said container, said moveable valve cup member being engageable with said second end, said contents of said pressurized container being dispensable when said one end is tiltably displaced relative to its generally straight upright extended position by an external deflecting operating force applied thereagainst, thereby opening said seal means, said moveable valve cup member including:

(A) a base portion extending across said second end of said tubular nozzle means, (B) rib means upstanding from said base portion for engaging said resilient seal member peripherally of said tubular nozzle means, (C) camming means centrally upstanding from said base portion and slidably engagable with portions of said second end of said tubular nozzle means when said one end is so tiltably displaced, whereby deflection of said moveable valve cup member occurs when said second end slides along said camming means, (D) guidance means for orienting said moveable valve cup member relative to said mounting cup member for stable reciprocal sliding movements longitudinally relative to said mounting cup member, and (E) channel means defined by said moveable valve cup member longitudinally extending therethrough adapted for the laminar flow of a viscous fluid therethrough, the interrelationship between said moveable valve cup member, said tubular nozzle means, said resilient seal member, and said mounting cup member being such that a substantially unobstructed flow of said contents through said valve structure can occur when said one end is so tiltably displaced and also such that when said tubular nozzle means is so tiltably displaced, said second end first exerts said operating force against said base portion and thereafter, as said tiltable displacement increases, said second end next exerts said operating force against said camming means.

2. The valve structure of claim 1, wherein said channel means has as effective cross-sectional area which is at least equal to the effective cross-sectional area of said tubular nozzle means.

3. A device for dispensing a highly viscous liquid comprising:

(A) a pressurizable container, (B) a fluid dispensing valve structure secured to said container and having fluid communication with the interior thereof, and (C) said valve structure being as described in claim 1.

4. An improved moveable valve cup member for a fluid dispensing valve structure of the type having a mounting cup member, a resilient seal member, an elongated tubular nozzle means having an outer and an inner end, and a moveable valve cup member, said valve structure being adapted to dispense therethrough the contents of a pressurized container with which said valve structure is functionally associated, said contents being dispensable through said valve structure when said nozzle is tilted relative to said mounting cup member to open a normally closed seal between said seal member and said moveable valve cup member, said moveable valve cup member comprising:

(A) a base portion extending across said second end of said tubular nozzle means, (B) annular rib means upstanding from said base portion for engaging said resilient seal member peripherally of said tubular nozzle means, (C) camming means centrally upstanding from said base portion and slidably engageable with portions of said second end of said tubular nozzle means when said one end is so tiltably displaced, whereby when said tubular nozzle means is so tiltably displaced, said second end first exerts an operating force against said base portion and thereafter, as said tiltable displacment increases, said second end next exerts said operating force against said camming means, and (D) sidewall means for orienting said moveable valve cup member relative to said mounting cup member for stable reciprocal sliding movements longitudinally relative to said mounting cup member.

5. The moveable valve cup member of claim 4 additionally including channel forming means defined by said moveable valve cup member, said channel forming means extending longitudinally and being adapted for nonturbulent flow of a viscous fluid thereby.

6. The moveable valve cup member of claim 5 further including a plurality of second rib means radially outwardly extending from said base portion for slidably reciprocally guiding said moveable cup member relative to said mounting cup member and wherein circumferentially adjacent pairs of said second rib means define therebetween said channel forming means.

7. A fluid dispensing valve structure for dispensing the viscous contents of a pressurized container comprising:

a valve mounting cup member peripherally sealingly securable to said pressurized container and having generally continuous walls with a central aperture defined therein, said continuous walls defining an interior valve receiving chamber adjacent to said central aperture, a resilient seal member carried within said mounting cup member radially adjacent said central aperture, an elongated tubular nozzle means having a dispensing orifice in one end thereof and having a second opposed and outwardly flanged end extending through said central aperture and supported in said mounting cup member by said resilient seal member in a normally generally straight upright extended position, a moveable valve cup member longitudinally reciprocally slidably carried within said valve receiving chamber and biasable against said resilient seal member to form a seal means for normally sealing the contents of said container, said moveable valve cup member being engageable with said second end, said contents of said pressurized container being dispensable when said one end is tiltably displaced relative to said generally straight upright extended position by an external deflecting operating force applied thereagainst, thereby opening said seal means, said moveable valve cup member including:

(A) an integral base portion extending across said second end of said tubular nozzle means, (B) an integral annular first rib means upstanding from said base portion for engaging said resilient seal member peripherally of said tubular nozzle means to form said seal means, when said tubular nozzle means is in said upright position, (C) a plurality of integral second rib means radially outwardly extending from said base portion for slidably reciprocally guiding said moveable valve cup member relative to said mounting cup member, circumferentially adjacent pairs of said second rib means defining therebetween passageways for the movement therethrough of said contents when said one end is so tiltably displaced, and (D) camming means centrally upstanding from said base portion and slidably engageable with portions of said second end of said tubular nozzle means when said one end is so tiltably displaced, whereby deflection of said moveable valve cup member occurs when said second end slides along said camming means, the interrelationship between said moveable cup member, said tubular nozzle means, said resilient seal member, and said mounting cup member being such that a substantially unobstructed and non-turbulent flow of said contents through said valve structure can occur when said one end is so tiltably displaced and also such that when said tubular nozzle means is so tiltably displaced, said second end first exerts said operating force against said base portion and thereafter, as said tiltable displacement increases, said second end next exerts said operating force against said camming means.

8. The valve structure of claim 7, so secured to said pressurized container and wherein said pressurized contents provide yielding biasing means urging formation of said seal means.

9. The fluid dispensing valve structure of claim 7 wherein said moveable valve cup member is cross-sectionally generally polygonally configured and wherein individual ones of said second rib means are each defined by a different corner, each corner being formed by the the juncture of two adjacent polygon sides, and wherein individual ones of said channel means are each defined adjacently to a different said polygon side.

10. The valve structure of claim 7, additionally including retaining means which limits extent of such slidability of said moveable valve cup member relative to said mounting cup member away from said resilient seal member and which retains said valve structure in an assembled configuration.

11. The valve structure of claim 10, wherein said camming means is conically shaped.

12. The valve structure of claim 10, wherein said camming means is hemispherically shaped.

13. The valve structure of claim 10, wherein said camming means is elliptically shaped in vertical axial cross-section.

14. The valve structure of claim 10, additionally including spring means urging formation of said seal means, said spring means extending between retaining means and said moveable cup member.

15. The valve structure of claim 10, wherein said retaining means comprises bridge support means which includes fastening means mounting said bridge support means to said mounting cup member and which includes a centrally disposed spider having a plurality of radially extending integral joining members connecting an integral mid portion with peripheral portions of said bridge support means, circumferentially adjacent pairs of said joining members defining therebetween relatively large passageways for the movement therethrough of said contents when said one end is so tiltably displaced.

16. The valve structure of claim 15, wherein said mid portion has a boss defined therein which is adapted to position a compression spring means urging formation of said seal means and extending between said boss and said moveable cup member.

17. The valve structure of claim 15 wherein said fastening means consists of an interference fit between peripheral portions of said bridge support means and said mounting cup member.

18. The valve structure of claim 7, wherein said plurality of second rib means extends from said base portion longitudinally away from said resilient seal member along said moveable valve cup member to a distance at least sufficient to avoid any appreciable cocking of said moveable valve cup member relative to said mounting cup member.

19. The valve structure of claim 18, wherein said moveable cup member further includes integral support means extending from said base portion for rigidifying said plurality of second rib means.

20. The valve structure of claim 19, wherein said support means comprises a continuous circumferentially extending apron interconnected to said base portion and to radially interior ends of each of said plurality of second rib means.

21. The valve structure of claim 19, wherein said support means comprises the interconnected interior ends of each of said plurality of second rib means.

* * * * *